US005899329A

United States Patent [19]

Hu et al.

[11] Patent Number: 5,899,329

[45] Date of Patent: May 4, 1999

[54] DISPLAY TOOL BOX

[75] Inventors: Bobby Hu, Taipei; David Ling, Taichung, both of Taiwan

[73] Assignee: Hand Tool Design Corporation, Wilmington, Del.

[21] Appl. No.: 08/957,969

[22] Filed: Oct. 21, 1997

[51] Int. Cl.[6] ..... B65D 85/28

[52] U.S. Cl. ..... 206/376; 206/486; 206/806

[58] Field of Search ..... 206/372, 376, 206/373, 804, 806, 562, 45.24, 488, 486

[56] References Cited

U.S. PATENT DOCUMENTS

| | | | |
|---|---|---|---|
| 880,590 | 3/1908 | Sommer | 206/45.24 |
| 5,203,469 | 4/1993 | Chang et al. | 206/378 |
| 5,205,474 | 4/1993 | Stuart et al. | 206/562 |
| 5,372,273 | 12/1994 | Eves | 220/507 |
| 5,509,528 | 4/1996 | Weisburn | 206/45.24 |
| 5,570,784 | 11/1996 | Sidabras et al. | 206/378 |
| 5,598,924 | 2/1997 | McCann | 206/372 |
| 5,730,303 | 3/1998 | Chow | 206/372 |
| 5,785,174 | 7/1998 | Chow | 206/376 |

*Primary Examiner*—Paul T. Sewell
*Assistant Examiner*—Nhan T. Lam
*Attorney, Agent, or Firm*—Charles E. Baxley, Esq.

[57] ABSTRACT

A display tool box includes a base having a receiving area with a plurality of recesses defined therein so as to receive tools in the recesses and an operation area having a hole defined therethrough which has a toothed inner periphery for a ratchet member rotatably engaged therewith so that a tool, such as a box end wrench is mounted to the ratchet member and can rotate the ratchet member.

4 Claims, 7 Drawing Sheets

DISPLAY TOOL BOX

BACKGROUND OF THE INVENTION

1. Field of the Invention

The present invention relates to a display tool box and, more particularly, to an improved tool box having a receiving area and an operation area including a rotatable ratchet member and a tool, such as a spanner, rotatably engaged with the ratchet member so that a user may operate the tool in the operation area.

2. Brief Description of the Prior Art

A conventional display box generally is a plastic box for receiving a plurality of tools therein and having a transparent cover so that customers may see the tools via the transparent cover. However, such tools are not designed for simply having decorative purposes so that the conventional display tool boxes cannot meet needs of customers who want to operate the tools themselves. Furthermore, for manufacturers, the tools they produced once are put in the conventional display tool boxes will not able to show their special characters because customers cannot even touch them. Accordingly, the customers, the manufacturers and the dealers have the same need to have a new display tool box having a new style of displaying.

The present invention intends to provide an improved display tool box to mitigate and/or obviate the above-mentioned problems.

SUMMARY OF THE INVENTION

In one aspect of the present invention, there is provided a display tool box comprising a base having a receiving area with a plurality of recesses defined therein and an operation area having a hole defined therethrough which has a toothed inner periphery for a ratchet member rotatably engaged therewith.

It is an object of the present invention to provide a display tool box having an operation area to allow a customer to operate a tool in the operation area.

It is another object of the present invention to provide a display tool box having a stand which can be pivoted to be hung on a hook on a wall.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
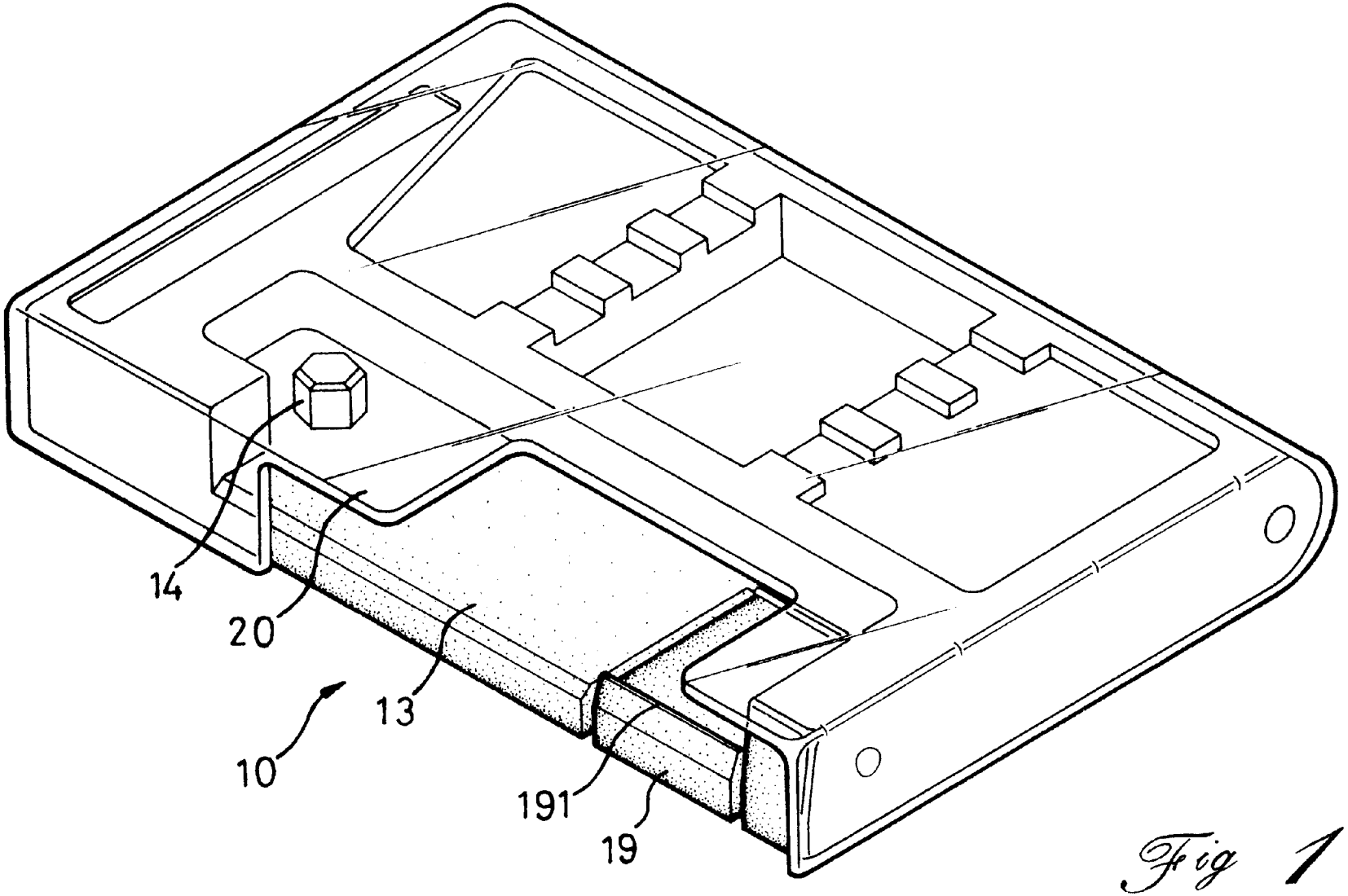
FIG. 1 is a perspective view of a display tool box in accordance with the present invention.
Figure 2:
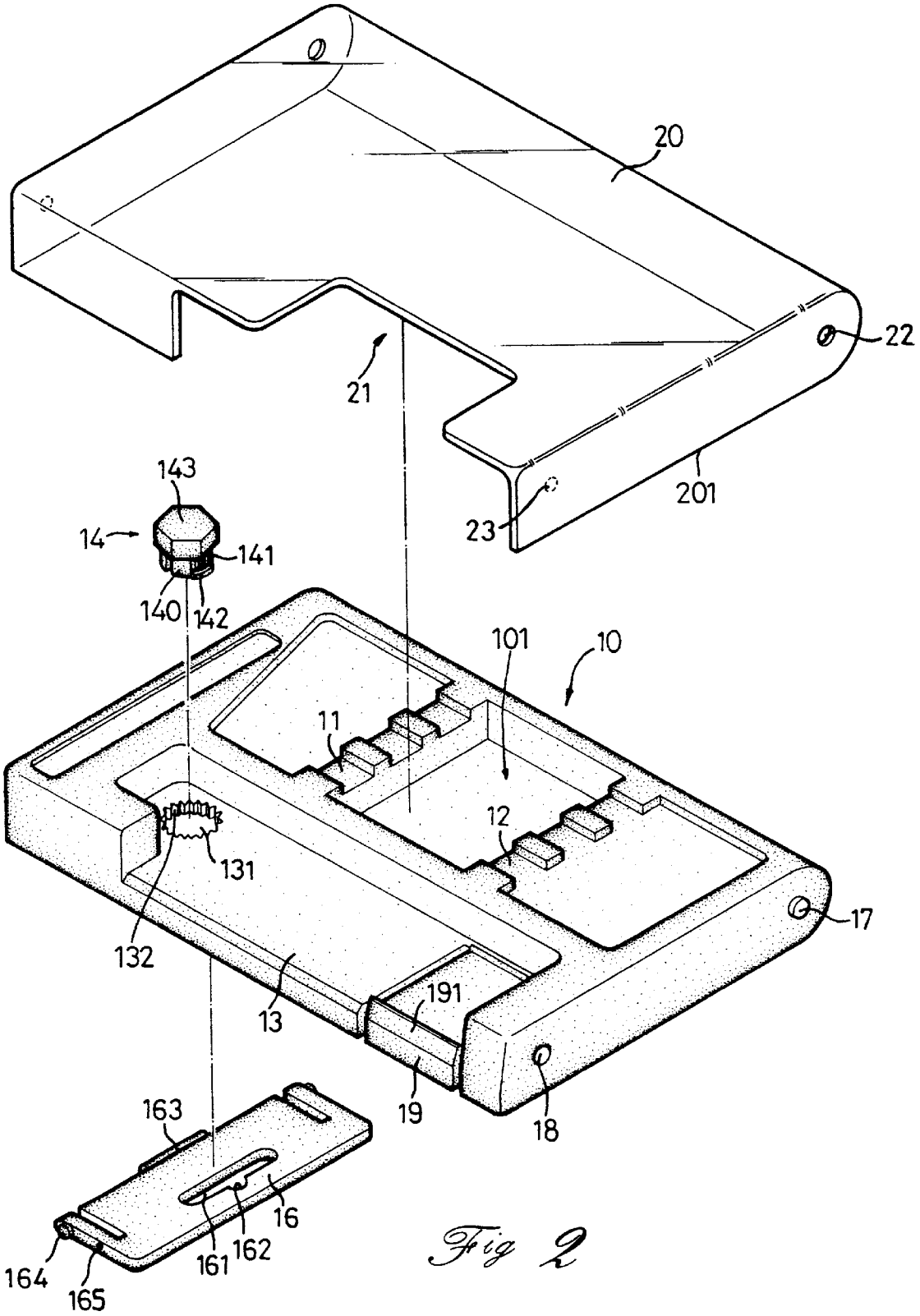
FIG. 2 is an exploded view of the display tool box in accordance with the present invention.
Figure 3:
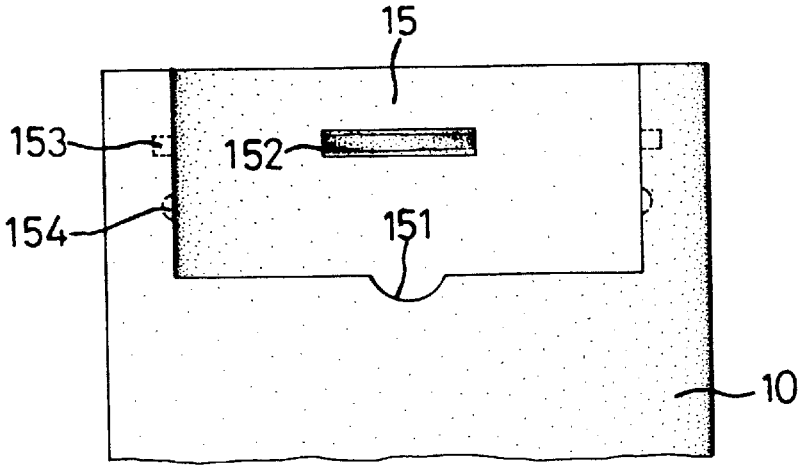
FIG. 3 is a bottom view to show a receiving portion defined in an under side of the base.
Figure 4:
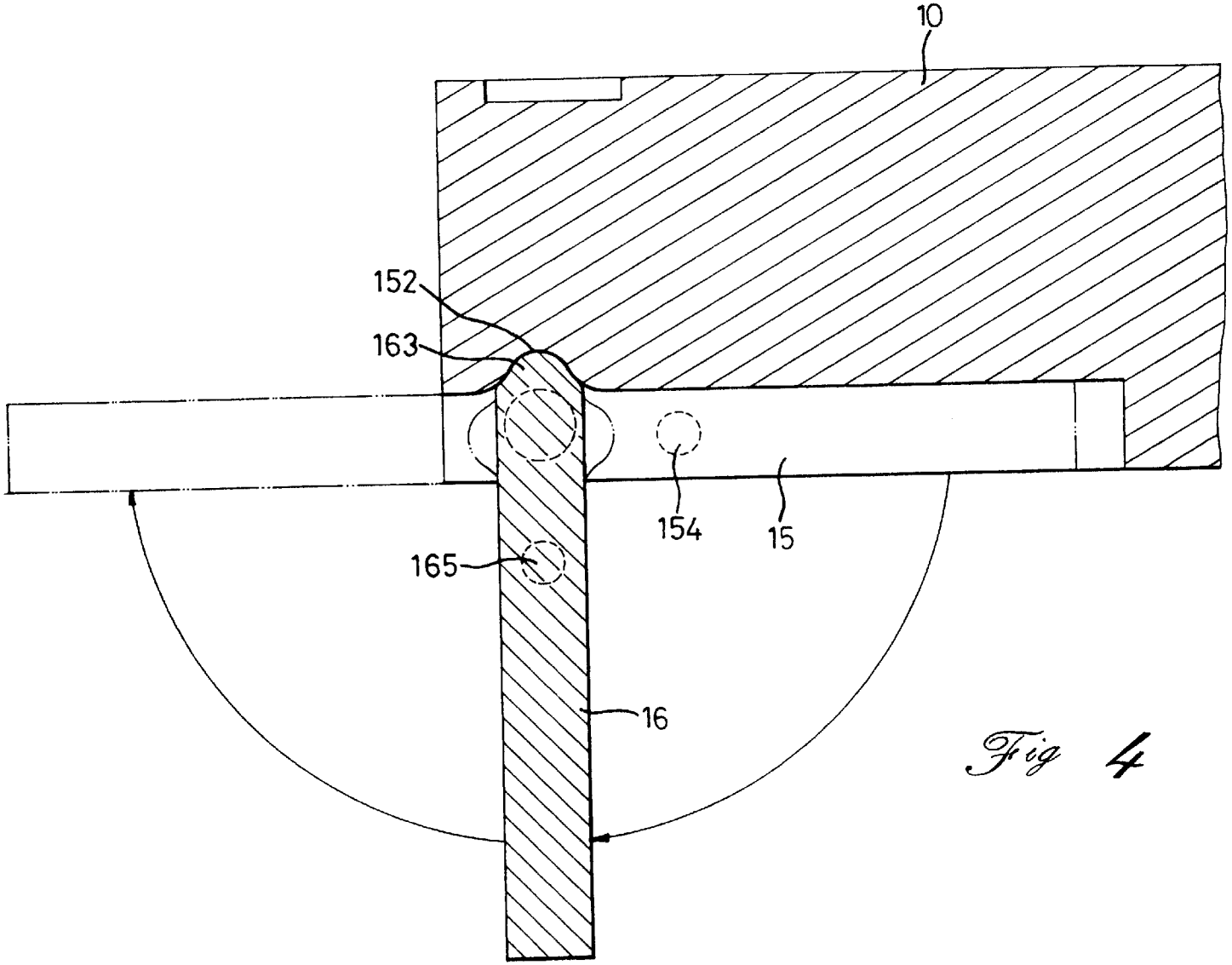
FIG. 4 is a side elevational view, partly in section, of a stand pivotally received in the receiving portion of the base.

Referring to the drawings and initially to FIGS. 1 through 3, a display tool box in accordance with the present invention generally includes a base 10 having a receiving area 101 with a plurality of recesses 11, 12 defined therein so as to receive tools, such as combination box and open end wrenches 30 (see FIG. 6) therein and a recessed operation area 13 having a hole 131 defined therethrough which has a toothed inner periphery 132 for a ratchet member 14 rotatably engaged therewith. The base 10 has a stud 17 and a dent 18 respectively extending from and defined in each one of two ends thereof. Referring to FIGS. 3 and 4, the base 10 has a recessed portion 15 defined in an under side thereof and a slot 152 is defined in a bottom defining the recessed portion 15. Two sides defining the recessed portion 15 each have a first recess 153 and a second recess 154 defined therein.

The ratchet member 14 has a polygonal head 143 and two curved portions 140 extending from the polygonal head 143 so that the two curved portions 140 can be pressed to approach with each other slightly. Each of the two curved portions 140 has a toothed outer periphery 141 and a flange 142 extending from a lower edge thereof so that the two toothed outer peripheries 141 are engaged with the toothed inner periphery 132 of the hole 131 and the flanges 142 limit the ratchet member 14 from being disengaged from the toothed inner periphery 132.

A flexible plate 19 is connected to the base 10 and located next to the operation area 13, the flexible plate 19 has a second flange 191 extending upwardly therefrom and being flush with a side of the operation area 13.

A transparent cover 20 has two end skirts 201 extending downwardly from two opposite ends thereof and each end skirt 201 has an aperture 22 defined therethrough for receiving the corresponding stud 17 therein and a boss 23 extends from an inner side thereof so as to be received in the dent 18 corresponding thereto such that the transparent cover 20 can be pivoted about an axis connecting the two studs 17. A cut-away 21 is defined in a side of the transparent cover 20 so that the operation area 13 can be accessed from the cut-away 21.

Figure 5:
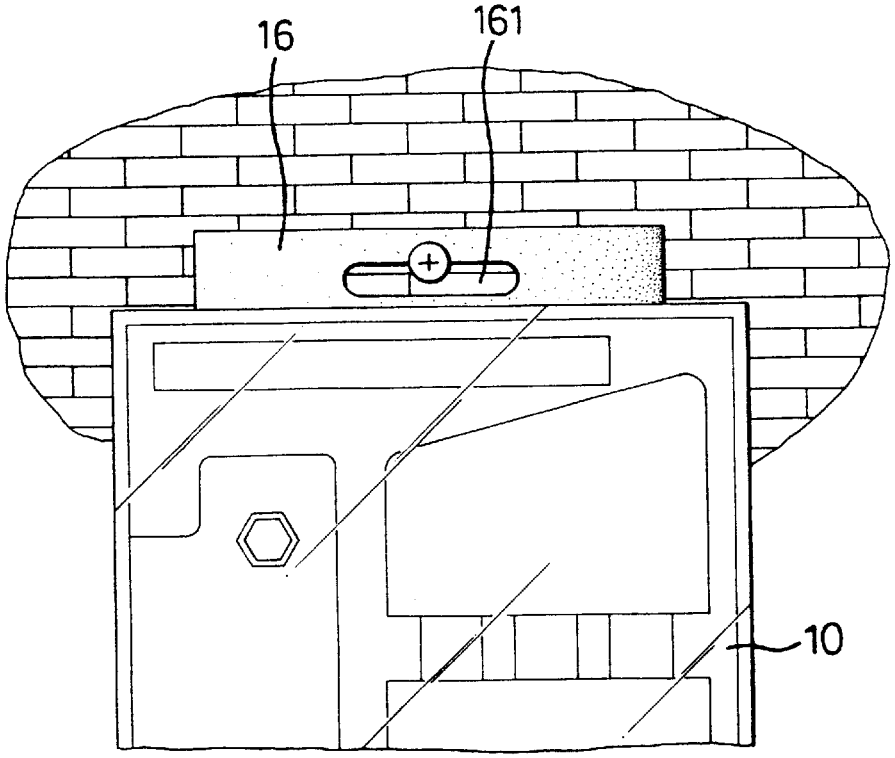
FIG. 5 is an illustrative view to show the stand can be hung on a bolt on a wall.

A stand 16 is pivotally disposed to the under side of the base 10 and is pivotally received in the recessed portion 15. The stand 16 has a first positioning protrusion 164 and a second positioning protrusion 165 extending from each one of two ends thereof so that the first positioning protrusions 164 are pivotally received in the first recesses 153 and the second positioning protrusions 165 are received in the second recesses 154 when the stand 16 is pivoted to received in the recessed portion 15. The stand 16 has a ridge 163 extending from one of two sides thereof so as to be pivotally received in the slot 152 when the stand 16 is pivoted perpendicular to the base 10 as shown FIG. 4. An inner end defining the recessed portion 15 has a finger recess 151 defined therein as shown in FIG. 3 so that a user's finger can insert into the finger recess 151 to pull the stand 16 downwardly. The stand 16 has a oblong hole 161 defined therethrough and a periphery defining the oblong hole 161 has a semi-circular recess 162 defined therein so that the stand 16 can be pivoted to a position parallel to the base 10 and be hung on a bolt on a wall as shown in FIG. 5.

Figure 6:
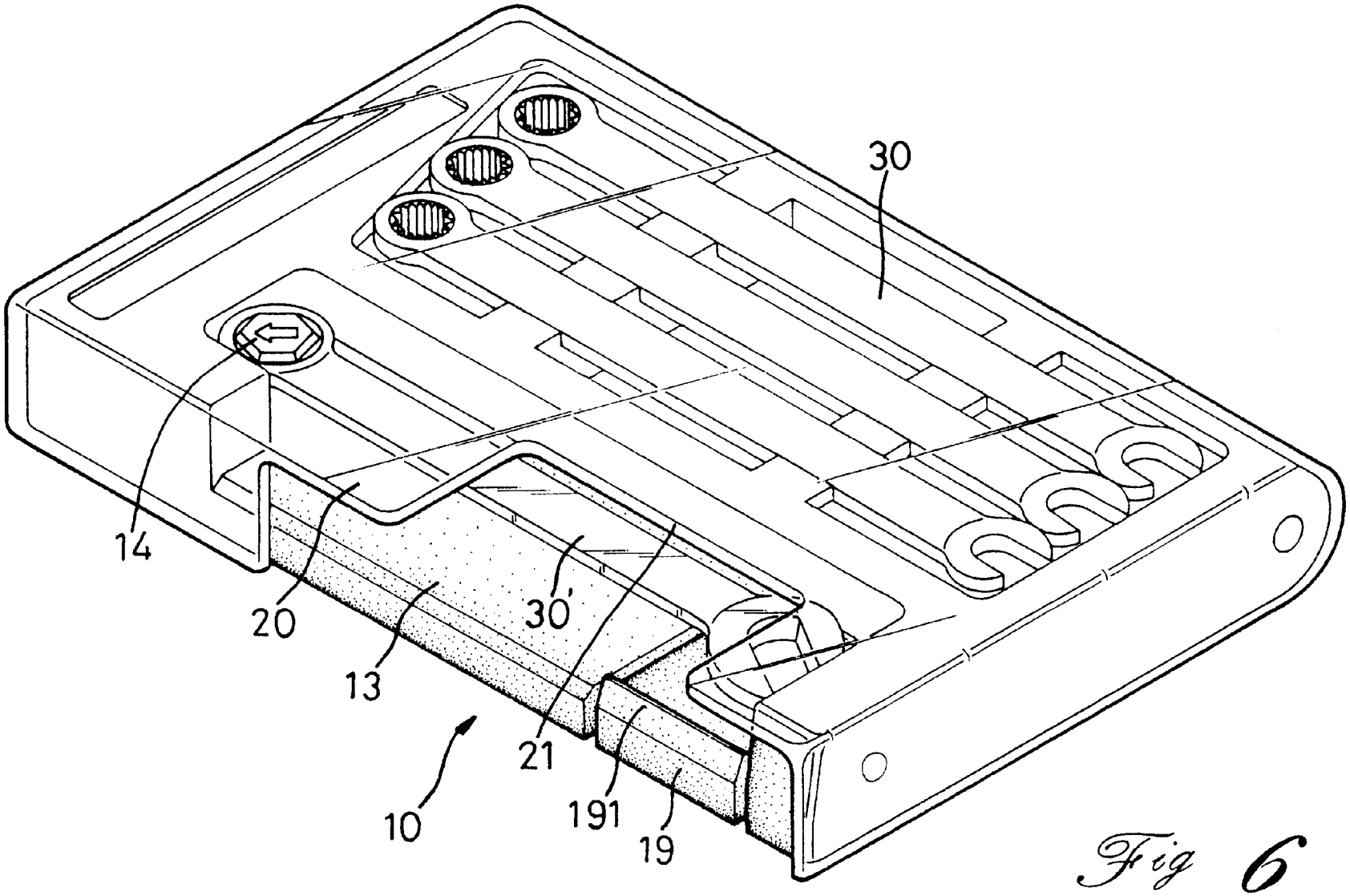
FIG. 6 is a perspective view of the display tool box in which tools are received.
Figure 7:
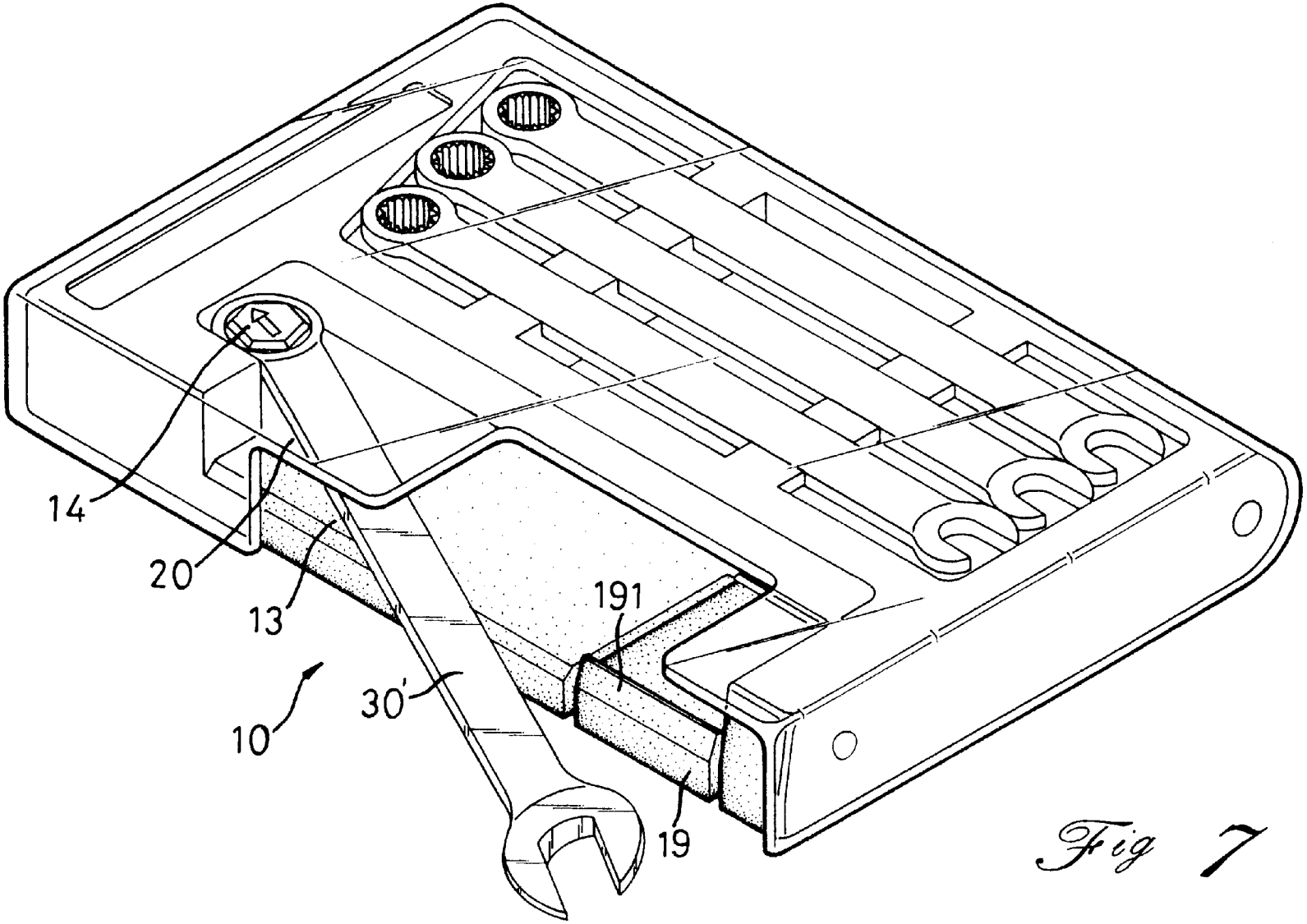
FIG. 7 is a perspective view of the display tool box in accordance with the present invention, wherein a tool in the operation area is pivoted outwardly.
Figure 8:
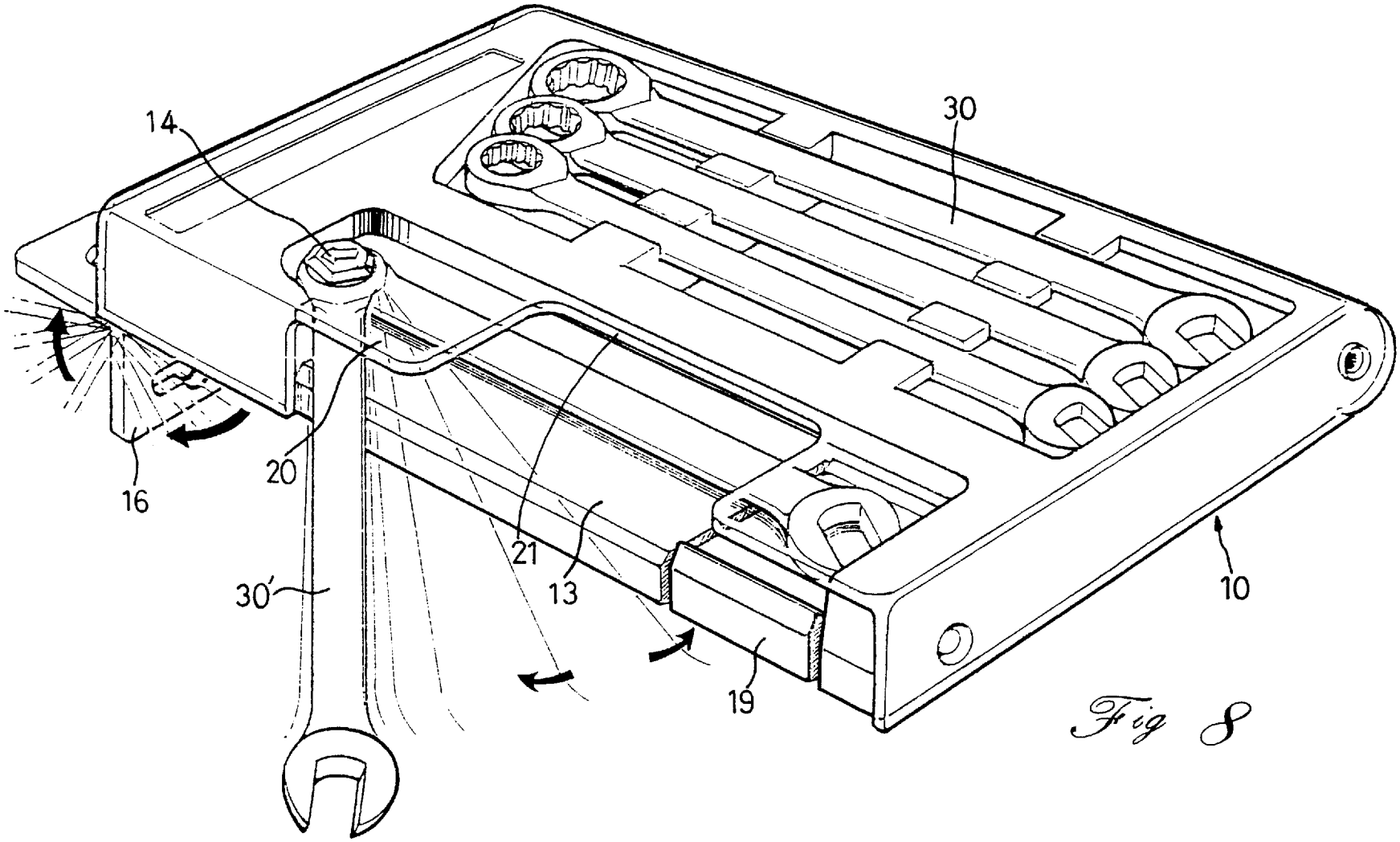
FIG. 8 is an illustrative view to show the tool in the operation area is pivoted about a ratchet member and a stand is pivoted from the base.

Referring now to FIGS. 6 through 8, the combination box and open end wrenches 30 are respectively received in the recesses 11, 12 in the receiving area 101 and one wrench 30' is received in the operation area 13 with its box end mounted to the polygonal head 143 of the ratchet member 14. The second flange 191 limits the wrench 30' from dropping from the operation area 13. An open end of the wrench 30' can be pulled outwardly by pushing the flexible plate 19 downwardly slightly so that the user can hold the wrench 30' and rotates the wrench 30' about the ratchet member 14 to let the toothed outer peripheries 141 move across the toothed inner periphery 132 of the hole 131.

Accordingly, the display tool box of the present invention includes the operation area 13 which provides a wrench 30' to be operated therein and this meets needs of the customers. Furthermore, the stand 16 is conveniently to let the display tool box be hung on the wall or stand on a table.

Although the invention has been explained in relation to its preferred embodiment, it is to be understood that many other possible modifications and variations can be made without departing from the spirit and scope of the invention as hereinafter claimed.

What is claimed is:

1. A display tool box comprising:

a base having a receiving area with a plurality of recesses defined therein and an operation area having a hole defined therethrough which has a toothed inner periphery, and a ratchet member rotatably engaged in said toothed inner periphery;

a flexible plate connected to said base and located next to said operation area, said flexible plate having a first flange and a second flange extending upwardly therefrom and being flush with a side of said operation area.

2. The display tool box as claimed in claim 1 wherein said base has a stud and a dent respectively formed on each one of two ends thereof, a transparent cover having two end skirts extending downwardly from two opposite ends thereof and each end skirt having an aperture defined therethrough for receiving said corresponding stud therein and a boss extending from an inner side thereof so as to be received in said dent corresponding thereto.

3. The display tool box as claimed in claim 1 wherein a stand is pivotally disposed to an under side of said base.

4. A display tool box comprising:

a base having a receiving area with a plurality of recesses defined therein and an operation area having a hole defined therethrough which has a toothed inner periphery;

a ratchet member rotatably engaged in said toothed inner periphery wherein a stand is pivotally disposed to an under side of the base and wherein said under side of said base has a recessed portion defined therein and a slot is defined in a bottom defining said recessed portion, two sides defining said recessed portion each having a first recess and a second recess defined therein, said stand having a ridge extending from one of two sides thereof so as to be pivotally received in said slot when said stand is pivoted perpendicular to said base, said stand having a first positioning protrusion and a second positioning protrusion extending from each one of two ends thereof so that said first positioning protrusions are pivotally received in said first recesses and said second positioning protrusions are received in said second recesses when said stand is pivoted to be received in said recessed portion.

* * * * *